US007559777B2

(12) United States Patent
Lin et al.

(10) Patent No.: US 7,559,777 B2
(45) Date of Patent: Jul. 14, 2009

(54) ELECTRICAL CONNECTOR FOR CONNECTING ELECTRICALLY AN ANTENNA MODULE TO A GROUNDING PLATE

(75) Inventors: Sheng-Chih Lin, Taipei (TW); Tsung-Wen Chiu, Taipei (TW); Fu-Ren Hsiao, Taipei (TW); Sih-Ji Wang, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/960,947

(22) Filed: Dec. 20, 2007

(65) Prior Publication Data

US 2008/0153329 A1 Jun. 26, 2008

(30) Foreign Application Priority Data

Dec. 22, 2006 (TW) ..... 95148401 A

(51) Int. Cl.
*H01R 4/66* (2006.01)

(52) U.S. Cl. ..... 439/108

(58) Field of Classification Search ..... 439/98, 439/108, 92, 399, 397, 394, 881, 582, 730, 439/741

See application file for complete search history.

(56) References Cited

U.S. PATENT DOCUMENTS

| | | | | |
|---|---|---|---|---|
| 7,354,283 | B2 * | 4/2008 | Onuma et al. | 439/92 |
| 2006/0189184 | A1 * | 8/2006 | Onuma | 439/98 |
| 2008/0143635 | A1 * | 6/2008 | Lin et al. | 343/906 |

* cited by examiner

*Primary Examiner*—Edwin A. Leon
(74) *Attorney, Agent, or Firm*—Frommer Lawrence & Haug LLP; Ronald R. Santucci

(57) ABSTRACT

An electrical connector includes a top plate, a first clamping plate extending integrally and downwardly from a first side of the top plate, and a second clamping plate extending integrally and downwardly from a second side of the top plate, and cooperating with the top plate and the first clamping plate to define a clamp for clamping a grounding plate. A connecting member extends integrally from the second side of the top plate and is connected electrically to a ground pattern provided on a circuit board of an antenna module.

8 Claims, 4 Drawing Sheets

ELECTRICAL CONNECTOR FOR CONNECTING ELECTRICALLY AN ANTENNA MODULE TO A GROUNDING PLATE

CROSS-REFERENCE TO RELATED APPLICATION

This application claims priority of Taiwanese Application No. 095148401, filed on Dec. 22, 2006, the disclosure of which is incorporated herein by reference.

BACKGROUND OF THE INVENTION

1. Field of the Invention

The invention relates to an electrical connector, more particularly to an electrical connector for electrically connecting an antenna module to a grounding plate.

2. Description of the Related Art

FIG. 1 illustrates a conventional antenna module 11 of an electronic device (not shown), such as a notebook computer or a cell phone, connected electrically to an L-shaped grounding plate 12 via a sheet of tinfoil 13. The grounding plate 12 can be a part of a casing of the electronic device, and has a main plate body 121, and an extension 122 extending from one side of the main plate body 121 and perpendicular to the main plate body 121. The antenna module 11 includes a circuit board 111 disposed on the extension 122 of the grounding plate 12, and two transmission wires 112 connected electrically to the circuit board 111. The sheet of tinfoil 13 is attached over a limited part of a surface of the circuit board 111, the extension 122 and the main plate body 121 such that the antenna module 11 is connected electrically to the grounding plate 12.

However, tinfoil has a relatively high cost, and it is difficult to attach evenly the sheet of tinfoil 13 to the circuit board 111 and the grounding plate 12. Moreover, since the sheet of tinfoil 13 is attached to the limited part of the surface of the circuit board 111, it is likely to separate from the circuit board 111. As a result, electrical connection between the antenna module 11 and the grounding plate 12 cannot be ensured.

SUMMARY OF THE INVENTION

Therefore, the object of the present invention is to provide an electrical connector for electrically connecting an antenna module to a grounding plate that can overcome the aforesaid drawbacks of the prior art.

According to one aspect of the present invention, there is provided an electrical connector for connecting electrically an antenna module to an L-shaped grounding plate. The antenna module includes a circuit board provided with a ground pattern thereon. The grounding plate has a main plate body, and an extension extending from one side of the main plate body and perpendicular to the main plate body. The electrical connector comprises:

a top plate having opposite first and second sides;

a first clamping plate extending integrally and downwardly from the first side of the top plate;

a second clamping plate extending integrally and downwardly from the second side of the top plate, the second clamping plate cooperating with the top plate and the first clamping plate to define a clamp adapted to clamp an upper end of the extension of the grounding plate; and a connecting member extending integrally from the second side of the top plate and adapted to be connected electrically to the ground pattern of the circuit board of the antenna module.

According to another aspect of the present invention, an antenna module assembly is adapted for electrical connection with an L-shaped grounding plate. The grounding plate has a main plate body, and an extension extending from one side of the main plate body and perpendicular to the main plate body. The antenna module assembly comprises:

an antenna module including a circuit board provided with a ground pattern thereon; and an electrical connector adapted for connecting electrically the ground pattern of the circuit board to the grounding plate, the electrical connector including a top plate having opposite first and second sides, a first clamping plate extending integrally and downwardly from the first side of the top plate, a second clamping plate extending integrally and downwardly from the second side of the top plate, the second clamping plate cooperating with the top plate and the first clamping plate to define a clamp adapted to clamp an upper end of the extension of the grounding plate, and a connecting member extending integrally from the second side of the top plate and connected electrically to the ground pattern of the circuit board of the antenna module.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
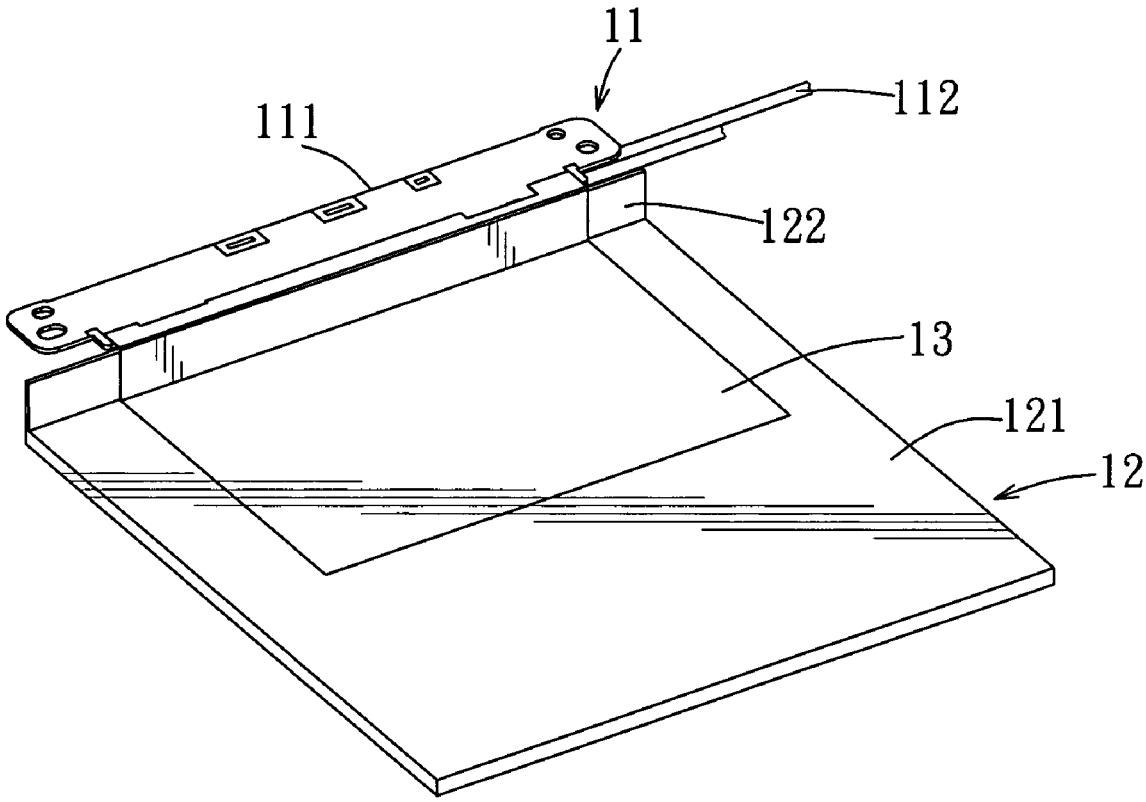
FIG. 1 PRIOR ART
FIG. 1 is a perspective view illustrating how a conventional antenna module is connected electrically to a grounding plate by a sheet of tinfoil.

Before the present invention is described in greater detail, it should be noted that like elements are denoted by the same reference numerals throughout the disclosure.

Figure 2:
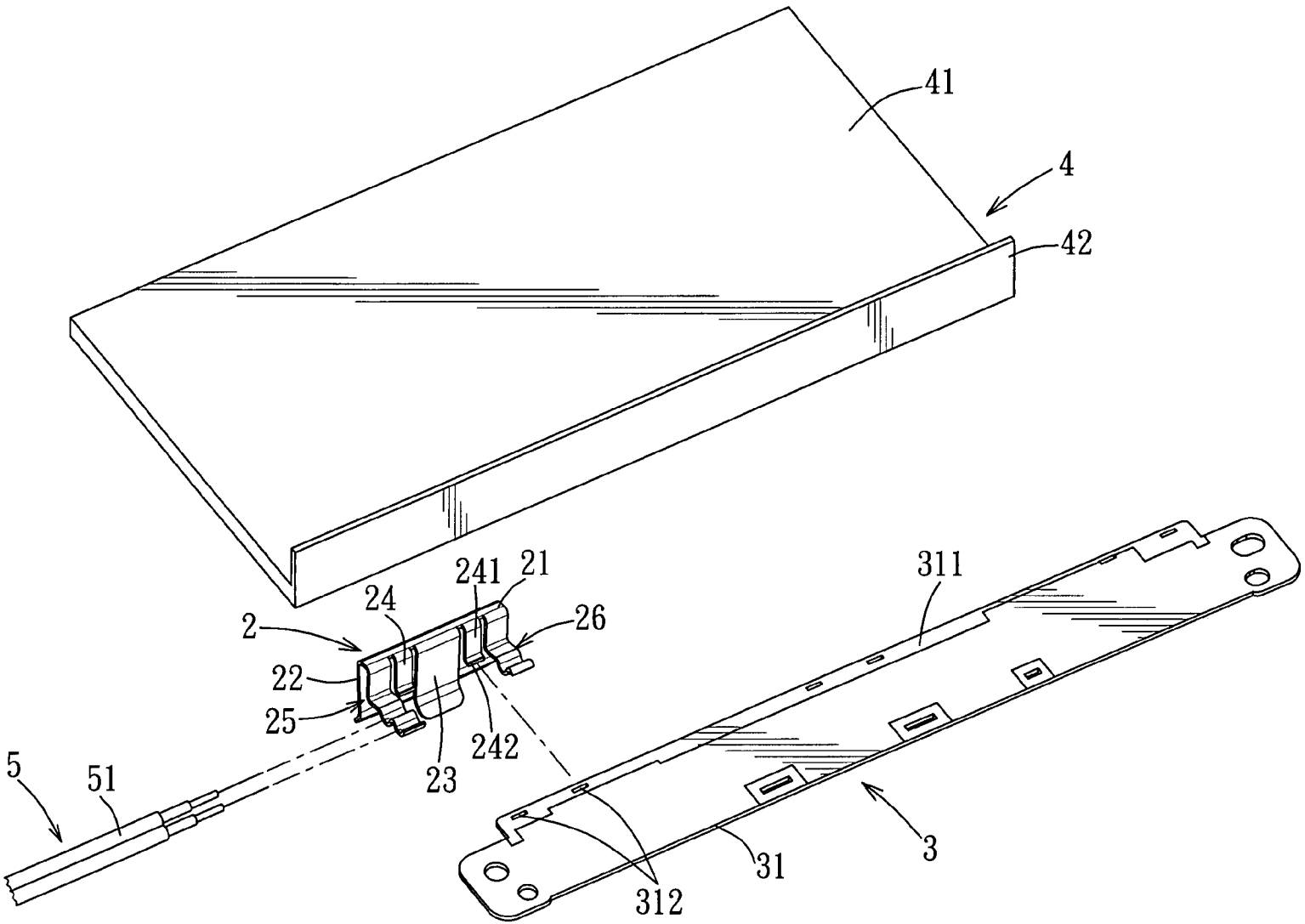
FIG. 2 is an exploded perspective view showing a first preferred embodiment of an antenna module assembly according to the present invention.
Figure 3:
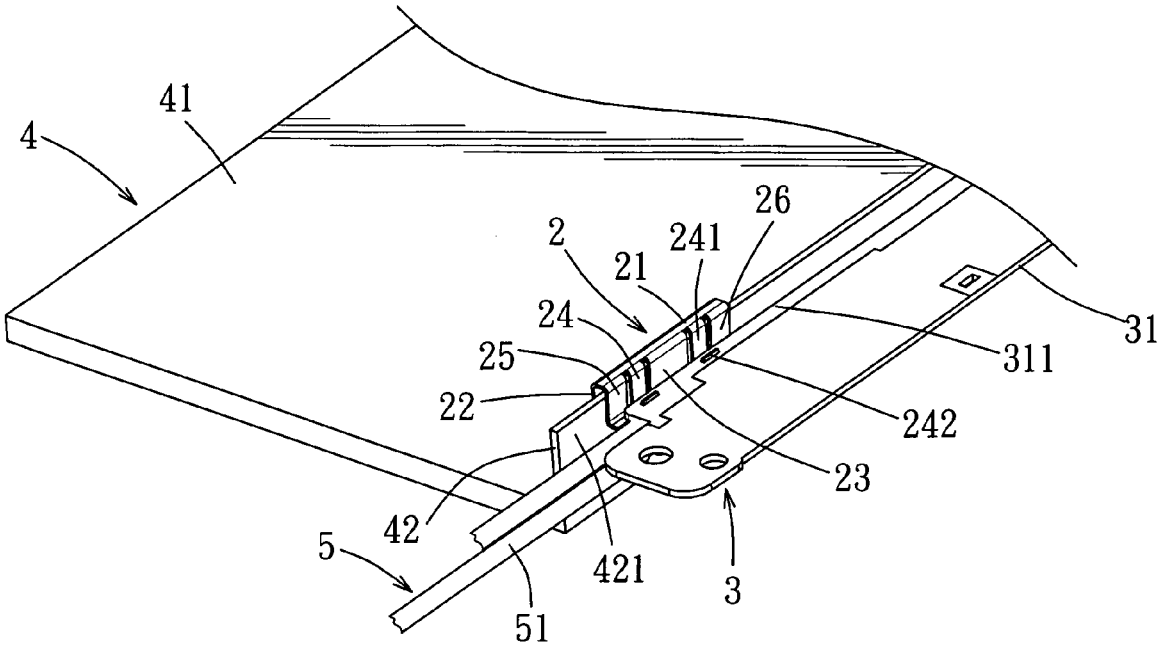
FIG. 3 is a fragmentary perspective view showing the first preferred embodiment connected electrically to a grounding plate.

Referring to FIGS. 2 and 3, a first preferred embodiment of an antenna module assembly of this invention is shown to be connected electrically to an L-shaped grounding plate 4. In this embodiment, the grounding plate 4 is a part of a conductive casing of an electronic device (not shown), and has a main plate body 41, and an extension 42 extending from one side of the main plate body 41 and perpendicular to the main plate body 41. The antenna module assembly includes an antenna module 3, an electrical connector 2, and a transmission wire unit 5.

The antenna module 3 includes a circuit board 31 provided with a ground pattern 311 thereon. In this embodiment, the ground pattern 311 is disposed at one side of the circuit board 31. The circuit board 31 is further formed with two through holes 312 spaced apart from each other and disposed within a region of the circuit board 31 where the ground pattern 311 is formed.

Figure 4:
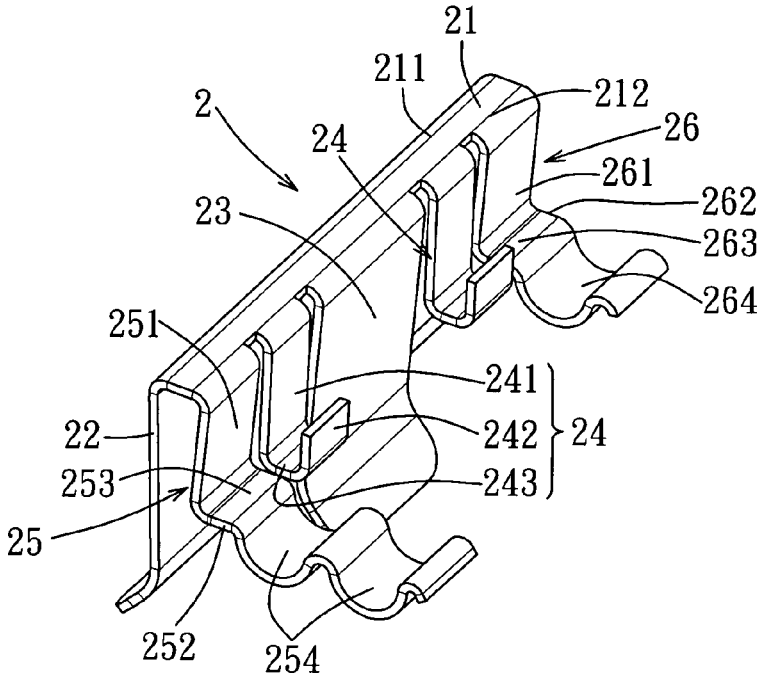
FIG. 4 is a perspective view showing an electrical connector of the first preferred embodiment.

The electrical connector 2 is adapted for connecting electrically to the ground pattern 311 of the circuit board 31 to the grounding plate 41. Referring further to FIG. 4, the electrical connector 2 is made of a resilient and conductive material, and includes a top plate 21, a first clamping plate 22, a second clamping plate 23, and a connecting member. The top plate 21 has opposite first and second sides 211, 212. The first clamping plate 22 extends integrally and downwardly from the first side 211 of the top plate 21. The second clamping plate 23 extends integrally and downwardly from the second side 212 of the top plate 21, and is disposed at the center of the second side 212 of the top plate 21. The second clamping plate 23 cooperates with the top plate 21 and the first clamping plate 22 to define a clamp adapted to clamp an upper end 421 of the extension 42 of the grounding plate 4. In this embodiment, the connecting member includes two connecting plates 24 that extend integrally from the second side 212 of the top plate 21 and that flank and that are spaced apart from the second clamping plate portion 23. Each connecting plate 24 has an upright first plate 241 extending downwardly from the second side 212 of the top plate 21, a horizontal second plate portion 243 extending from a lower end of the first plate portion 241 and away from the first clamping plate 22, and disposed under the circuit board 31, and a third plate portion 242 extending upwardly from an end of the second plate portion 243, extending through and engaging fittingly a corresponding one of the through holes 312 in the circuit board 31, and serving as a connecting end portion connected electrically to the ground pattern 311 of the circuit board 31. As a result, the ground pattern 311 of the circuit board 31 of the antenna module 3 is connected electrically to the grounding plate 4 via the electrical connector 2.

The electrical connector 2 further includes two positioning plates 25, 26 flanking the second clamping plate 23 and spaced respectively apart from the connecting plates 24 of the connecting member. Each of the positioning plates 25, 26 has a first plate portion 251, 261 extending integrally and downwardly from the second side 212 of the top plate 21, and a second plate portion 252, 262 connected integrally to a lower end of the first plate portion 251, 261, extending away from the first clamping plate 22 and disposed under the circuit board 31. The second plate portion 252, 262 of each of the positioning plates 25, 26 has a top surface 253, 263 formed with a slot unit, wherein the slot unit in the top surface 253 of the second plate portion 252 of the positioning plate 25 has two slots 254, while the slot unit in the top surface 263 of the second plate portion 262 of the positioning plate 26 has a single slot 264, as best shown in FIG. 4.

In this embodiment, the transmission wire unit 5 is to interconnect electrically the circuit board 31 and a radio frequency circuit (not shown), and has two transmission wires 51, one of which is received in a corresponding one of the slots 254 in the positioning plate 25 and the slot 264 in the positioning plate 26, and the other one of which is received in the other one of the slots 254 such that the transmission wire unit 5 is positioned between the circuit board 31 and the second plate portions 252, 262 of the positioning plates 25, 26, thereby facilitating subsequent assembly processes.

Figure 5:
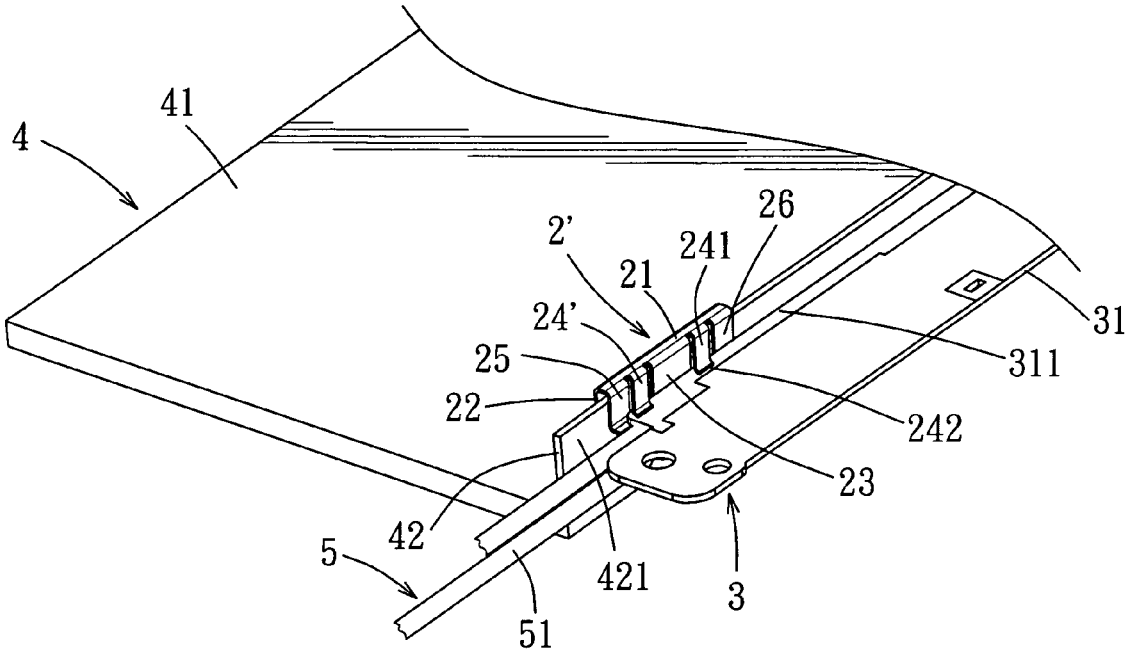
FIG. 5 is a fragmentary perspective view showing a second preferred embodiment, of an antenna-module assembly connected electrically to a grounding plate according to the present invention.
Figure 6:
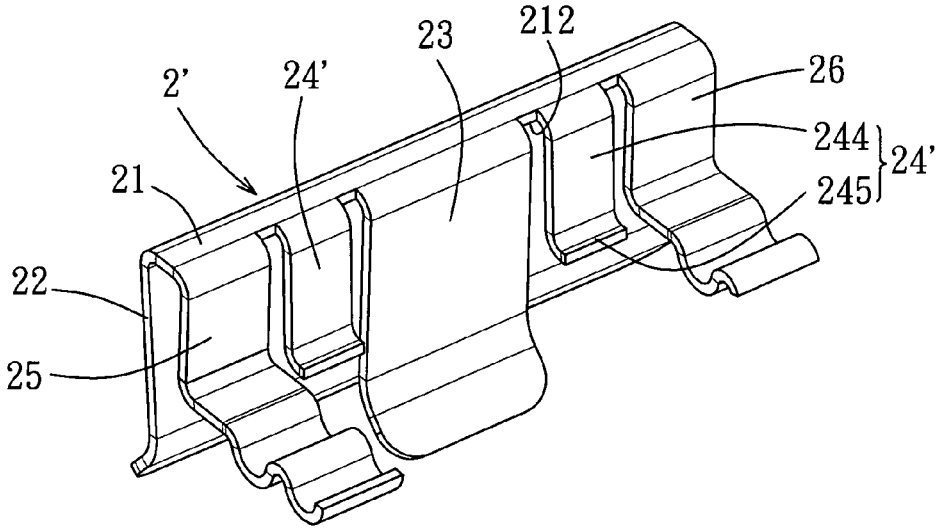
FIG. 6 is a perspective view showing an electrical connector of the second preferred embodiment.

FIGS. 5 and 6 illustrate a second preferred embodiment of an antenna module assembly according to this invention, which is a modification of the first preferred embodiment. In this embodiment, each connecting plate 24' of the electrical connector 2' is L-shaped, and has an upright plate portion 244 extending downwardly from the second side 212 of the top plate 21, and a connecting plate portion 245 extending from a lower end of the upright plate portion 244 and away from the first clamping plate 22, and connected electrically to the ground pattern 311 of the circuit board 31 by soldering.

In sum, the electrical connector 2, 2' has a clamp structure that can easily and securely clamp the upper end 421 of the extension 42 of the grounding plate 4, and the connecting plates 24, 24' that are connected electrically to the ground pattern 311 of the circuit board 31 of the antenna module 3 by soldering, thereby facilitating assembly and disassembly of the antenna module assembly of the present invention to and from the grounding plate 4, and ensuring electrical connection between the antenna module 3 and the grounding plate 4.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electrical connector for connecting electrically an antenna module to an L-shaped grounding plate, the antenna module including a circuit board provided with an L-shaped ground pattern thereon, the grounding plate having a main plate body, and an extension extending from one side of the main plate body and perpendicular to said main plate body, said electrical connector comprising:

a top plate having opposite first and second sides;

a first clamping plate extending integrally and downwardly from said first side of said top plate;

a second clamping plate extending integrally and downwardly from said second side of said top plate, said second clamping plate cooperating with said top plate and said first clamping plate to define a clamp adapted to clamp an upper end of the extension of the grounding plate; and a connecting member extending integrally from said second side of said top plate and adapted to be connected electrically to the ground pattern of the circuit board of the antenna module;

wherein said connecting member includes two connecting plates flanking and spaced apart from said second clamping plate, each of said connecting plates having a connecting end portion adapted to be connected electrically to the ground pattern of the circuit board of the antenna module.

2. The electrical connector as claimed in claim 1, wherein each of said connecting plates is L-shaped, and has an upright plate portion extending downwardly from said second side of said top plate, and a connecting plate portion extending from a lower end of said upright plate portion and away from said first clamping plate, and serving as said connecting end portion.

3. The electrical connector as claimed in claim 1, the circuit board of the antenna module being formed with two through holes spaced apart from each other and disposed within a region of the circuit board where the ground pattern is formed, wherein each of said connecting plates has an upright first plate portion extending downwardly from said second side of said top plate, a horizontal second plate portion extending from a lower end of said first plate portion and away from said first clamping plate, and adapted to be disposed under the circuit board, and a third plate portion extending upwardly from an end of said second plate portion, adapted to extend through and engage fittingly a corresponding one of the through holes in the circuit board, and serving as said connecting end portion.

4. The electrical connector as claimed in claim 1, further comprising two positioning plates flanking said second clamping plate and spaced respectively apart from said connecting plates, each of said positioning plates having a first plate portion extending integrally and downwardly from said second side of said top plate, and a second plate portion connected integrally to a lower end of said first plate portion, extending away from said first clamping plate and adapted to be disposed under the circuit board, said second plate portion of each of said positioning plates having a top surface formed with a slot unit adapted to receive a transmission wire unit.

5. An antenna module assembly adapted for electrical connection with an L-shaped grounding plate having a main plate body, and an extension extending from one side of the main plate body and perpendicular to said main plate body, said antenna module assembly comprising:

an antenna module including a circuit board provided with a ground pattern thereon; and an electrical connector adapted for connecting electrically said ground pattern of said circuit board to the grounding plate, said electrical connector including a top plate having opposite first and second sides, a first clamping plate extending integrally and downwardly from said first side of said top plate, a second clamping plate extending integrally and downwardly from said second side of said top plate, said second clamping plate cooperating with said top plate and said first clamping plate to define a clamp adapted to clamp an upper end of the extension of the grounding plate, and a connecting member extending integrally from said second side of said top plate and connected electrically to said ground pattern of said circuit board of said antenna module;

wherein said connecting member includes two connecting plates flanking and spaced apart from said second clamping plate, each of said connecting plates having a connecting end portion connected electrically to said ground pattern of said circuit board of said antenna module.

6. The antenna module assembly as claimed in claim 5, wherein each of said connecting plates is L-shaped, and has an upright plate portion extending downwardly from said second side of said top plate, and a connecting plate portion extending from a lower end of said upright plate portion and away from said first clamping plate, and serving as said connecting end portion.

7. The antenna module assembly as claimed in claim 5, wherein:

said circuit board of said antenna module is formed with two through holes spaced apart from each other and disposed within a region of said circuit board where said ground pattern is formed; and each of said connecting plates has an upright first plate portion extending downwardly from said second side of said top plate, a horizontal second plate portion extending from a lower end of said first plate portion and away from said first clamping plate, and disposed under said circuit board, and a third plate portion extending upwardly from an end of said second plate portion, extending through and engaging fittingly a corresponding one of said through holes in said circuit board, and serving as said connecting end portion.

8. The antenna module assembly as claimed in claim 5, wherein said electrical connector further includes two positioning plates flanking said second clamping plate and spaced respectively apart from said connecting plates, each of said positioning plates having a first plate portion extending integrally and downwardly from said second side of said top plate, and a second plate portion connected integrally to a lower end of said first plate portion, extending away from said first clamping plate and disposed under said circuit board, said second plate portion of each of said positioning plates having a top surface formed with a slot unit, said antenna module assembly further comprising a transmission wire unit received in said slot units in said second plate portions of said positioning plates such that said transmission wire unit is positioned between said circuit board and said second plate portions of said positioning plates.

* * * * *